US006209180B1

(12) United States Patent
Amick

(10) Patent No.: US 6,209,180 B1
(45) Date of Patent: Apr. 3, 2001

(54) NON-TOXIC HIGH DENSITY SHOT FOR SHOTSHELLS

(75) Inventor: Darryl D Amick, Albany, OR (US)

(73) Assignee: Teledyne Industries, Albany, OR (US)

( * ) Notice: Subject to any disclaimer, the term of this patent is extended or adjusted under 35 U.S.C. 154(b) by 0 days.

(21) Appl. No.: 09/046,520

(22) Filed: Mar. 24, 1998

Related U.S. Application Data

(60) Provisional application No. 60/042,390, filed on Mar. 25, 1997.

(51) Int. Cl.[7] ..... B21K 21/06; F42B 7/04

(52) U.S. Cl. ..... 29/1.23; 102/459; 102/514; 102/516

(58) Field of Search ..... 102/448, 459, 102/501, 514–518; 29/1.23

(56) References Cited

U.S. PATENT DOCUMENTS

| | | | | |
|---|---|---|---|---|
| 270,101 | * | 1/1883 | Nordenfelt | 102/514 |
| 1,246,204 | | 11/1917 | Wilson . | |
| 3,363,561 | * | 1/1968 | Irons . | |
| 3,881,418 | * | 5/1975 | Sato et al. | 102/453 |
| 5,012,743 | * | 5/1991 | Denis et al. | 102/516 |
| 5,189,252 | * | 2/1993 | Huffman . | |
| 5,399,187 | * | 3/1995 | Mravic . | |
| 5,747,724 | * | 5/1998 | Lindgren et al. | 102/459 |
| 5,760,331 | * | 6/1998 | Lowden et al. . | |

FOREIGN PATENT DOCUMENTS

| | | | | |
|---|---|---|---|---|
| 68800 | * | 6/1977 | (JP) | 102/514 |

* cited by examiner

*Primary Examiner*—Harold J. Tudor
(74) *Attorney, Agent, or Firm*—Shoemaker and Mattare

(57) ABSTRACT

A composite shot for shot shells includes a ferrous metal core and a non-toxic coating having a density greater than that of lead. The overall density of the shot is at least as great as that of lead.

1 Claim, 1 Drawing Sheet

NON-TOXIC HIGH DENSITY SHOT FOR SHOTSHELLS

This application claims priority from provisional patent application Ser. No. 60/042,390, filed Mar. 25, 1997.

BACKGROUND OF THE INVENTION

1. Field of the Invention

This invention relates to a non-toxic high density shot for shotshells and to the method for making it.

2. Description of the Previously Published Art

It is desirable to manufacture non-toxic shot for shotshells that have a density at least as great as lead, as a replacement for lead in shotgun shells.

Currently, steel shot having a significantly lower density than lead is employed with less than satisfactory performance.

OBJECTS OF THE INVENTION

It is an object of this invention to provide a high density composite non-toxic shot for shotshells which has the same density as traditional Pb shotgun media.

It is further object of this invention to provide a process for making a high density composite non-toxic shot for shotshells which has the same or greater density as traditional Pb—Sn shotgun media.

It is a further object of this invention to provide a process for making non-toxic shot by coating a steel core particle with a higher density coating material so that the resultant composite product has about the same density as traditional Pb shotgun media.

These and further objects of the i invention will become apparent as the description of the invention proceeds.

SUMMARY OF THE INVENTION

The foregoing and further objects and advantages are obtained by coating a ferrous metal spherical core with a non-toxic coating material having a higher density than the density of the core material.

BRIEF DESCRIPTION OF THE DRAWINGS

In the accompany drawings.

DESCRIPTION OF THE PREFERRED EMBODIMENTS

The current invention achieves the desired results by applying a high density coating to the surfaces of conventional steel shot at a sufficient thickness to approximate at least the density of lead in the coated composite articles.

Figure 1:
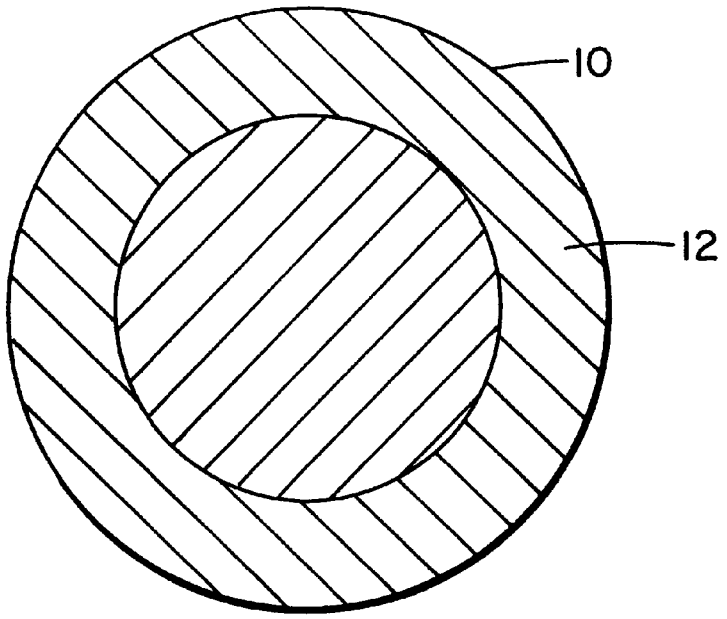
FIG. 1 is a cross-sectional view of a shot shell embodying the invention.
Figure 2:
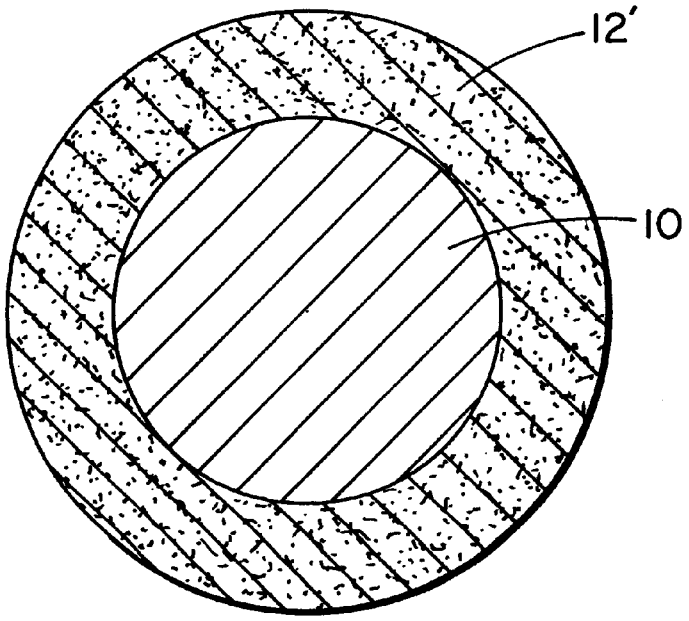
FIG. 2 is a view like FIG. 1, showing an alternative form of the invention.

As shown in FIGS. 1 and 2, in accordance with this invention, commercially available steel spheres having a density of 7.86 g/cm$^3$ may be coated with either tungsten having a density of 19.3 g/cm$^3$, tungsten compounds such as ferro-tungsten having a density of 14.5 g/cm$^3$ or other high density, non-toxic materials. A coating of tungsten of 0.0061 inch thickness, for example, on a #6 steel shotgun pellet having a diameter of 0.110 inch would result in a bulk density of 11.3 g/cm$^3$, which is equivalent to the density of pure lead (Pb).

FIG. 1 shows a spherical core 10 having a metallic coating layer 12, while FIG. 2 shows a coating layer 12' made from an epoxy-powder slurry.

The invention contemplates the possibility of coating steel spheres by a variety of processes including chemical vapor deposition (CVD), physical vapor deposition (PVD), electrolysis, plasma spraying, surface coating with composite slurries (e.g., epoxy and tungsten powder), surface coating by thermal bonding (e.g., sintering tungsten powder onto steel surfaces), and the like.

It is understood that the foregoing detailed description is given merely by way of illustration and that many variations may be made therein without departing from the spirit of this invention.

What is claimed is:

1. A method for making a non-toxic composite shot with a bulk density equivalent to that of traditional Pb shotgun media, said method comprising coating a steel sphere with a slurry of epoxy and tungsten powder.

* * * * *